US010631602B2

(12) United States Patent
Ahmed

(10) Patent No.: US 10,631,602 B2
(45) Date of Patent: Apr. 28, 2020

(54) UMBRELLA HOLDER

(71) Applicant: Humeira Basheer Ahmed, Walnut Creek, CA (US)

(72) Inventor: Humeira Basheer Ahmed, Walnut Creek, CA (US)

( * ) Notice: Subject to any disclaimer, the term of this patent is extended or adjusted under 35 U.S.C. 154(b) by 0 days.

(21) Appl. No.: 16/136,760

(22) Filed: Sep. 20, 2018

(65) Prior Publication Data

US 2020/0093230 A1 Mar. 26, 2020

(51) Int. Cl.
*A45F 3/04* (2006.01)
*A45B 11/02* (2006.01)
*A45F 3/00* (2006.01)

(52) U.S. Cl.
CPC ..... *A45B 11/02* (2013.01); *A45F 3/04* (2013.01); *A45B 2200/1009* (2013.01); *A45F 2003/003* (2013.01); *A45F 2200/05* (2013.01)

(58) Field of Classification Search
CPC ..... A45B 11/02; A45F 2003/142; A45F 2003/148; A45F 2200/0566; A45F 15/021; Y10S 224/915; A45C 13/40
See application file for complete search history.

(56) References Cited

U.S. PATENT DOCUMENTS 4,537,339 A * 8/1985 Pearson ..... A45B 11/02 224/186
5,230,452 A * 7/1993 Wagner ..... A01K 97/06 206/315.11
5,505,354 A * 4/1996 Hutton ..... A01K 97/06 206/315.11
5,513,786 A * 5/1996 Drane ..... A45B 11/02 135/34.2
6,502,283 B1 * 1/2003 Aguirre ..... A45B 1/04 135/65
6,523,918 B1 * 2/2003 Baiza ..... H05K 7/1489 211/26
6,619,520 B2 * 9/2003 Hammond ..... A45B 11/02 224/188
6,805,248 B2 * 10/2004 Champion ..... H05K 7/1491 211/26
6,811,039 B2 * 11/2004 Chen ..... A47B 96/06 211/26
6,866,173 B2 * 3/2005 Haber ..... A45F 3/04 224/160
6,902,069 B2 * 6/2005 Hartman ..... H02G 3/0456 211/26

(Continued)

*Primary Examiner* — Brian D Nash

(57) ABSTRACT

An umbrella holder for supporting an umbrella pole on a backpack strap so that the wearer of the backpack can be in a hands-free condition while the umbrella is deployed. The device includes a first panel, a second panel, a third panel, a pair of thumb screws and a panel closure member. The first panel is hinged to the second panel. The second panel is hinged to the third panel. The first and second panels create a retaining space for a backpack strap. The second and third panels create a retaining space for an umbrella pole. The thumb screws are hinge and tightened to secure a backpack strap. The second and third panels are held together by the panel closure member which is attached by a hinge to the first panel. A preferred embodiment includes rubber cushion members to securely hold umbrella poles of varying diameters.

3 Claims, 10 Drawing Sheets

(56) References Cited

U.S. PATENT DOCUMENTS

| | | | | |
|---|---|---|---|---|
| 7,026,551 | B2 * | 4/2006 | Franz | H02B 1/202 174/69 |
| 7,275,668 | B1 * | 10/2007 | Carroll | A45B 11/02 135/16 |
| 7,473,846 | B2 * | 1/2009 | Doerr | H05K 7/1491 174/68.3 |
| 7,959,048 | B1 * | 6/2011 | Cyr | A45C 5/06 224/651 |
| 8,132,582 | B2 * | 3/2012 | Goebel | A45B 11/02 135/16 |
| 9,961,987 | B1 * | 5/2018 | Harper | A45F 3/047 |
| 2004/0232186 | A1 * | 11/2004 | Huang | A45B 11/00 224/576 |
| 2007/0226958 | A1 * | 10/2007 | Clifton, Jr. | A45F 5/02 24/3.12 |
| 2009/0158788 | A1 * | 6/2009 | Rafferty | E05B 65/0089 70/77 |
| 2009/0174203 | A1 * | 7/2009 | Kim | A45F 3/14 294/156 |
| 2009/0194570 | A1 * | 8/2009 | Vadher | A45B 11/02 224/576 |
| 2010/0058526 | A1 * | 3/2010 | Tong | E03D 1/14 4/415 |
| 2011/0108588 | A1 * | 5/2011 | Bar | A45F 5/02 224/162 |
| 2018/0198968 | A1 * | 7/2018 | Heine | G03B 17/561 |

* cited by examiner

UMBRELLA HOLDER

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of accessories for a backpack and an umbrella and more specifically to a backpack strap umbrella holder.

The use of umbrellas during rainy or extremely sunny weather is well known. Umbrellas typically consist of a rigid pole and a fabric cover that is supported by a hinged collapsible support structure. Many people, also carry backpacks which can hold school items, camping items or any other variety of items such as sports clothing and equipment, food, tools and so forth.

There are instances where a person wearing a backpack is also holding other items in his or her hands and does not have the capacity to hold a deployed umbrella during rainy or extremely sunny weather.

To this end, it would be convenient and useful to provide a novel means for holding an umbrella in a hands-free manner while wearing a back pack.

BRIEF SUMMARY OF THE INVENTION

The primary object of the invention is to provide an umbrella holder that easily attaches to a backpack strap.

Another object of the invention is to provide an umbrella holder that allows the user to be hands free while the umbrella is in use.

Another object of the invention is to provide an umbrella holder that can be adjusted to fit a wide variety of umbrella poles and backpack straps.

A further object of the invention is to provide an umbrella holder that can remain on the backpack strap when not in use.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed an umbrella holder comprising: a first panel, a second panel, a third panel, a pair of thumb screws, a panel closure member, said first panel hinged to said second panel, said second panel hinged to said third panel, said first and second panels creating a retaining space for a backpack strap, said second and third panels creating a retaining space for an umbrella pole, said third panel including a U shaped channel for retaining said umbrella pole, said second panel including a pair of U shaped cutouts for retaining the screw of said thumb screw, said thumb screws being hingedly connected to the edge of said first panel, said thumb screws capable of engaging the said U shaped cutouts of said second panel and being tightened to secure a backpack strap, said second and third panels held together by said panel closure member, said panel closure member hingedly connected to said first panel, and said third panel including a connector receiving ridge to allow said panel closure member to snap onto said connector receiving ridge.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE DRAWINGS AND PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
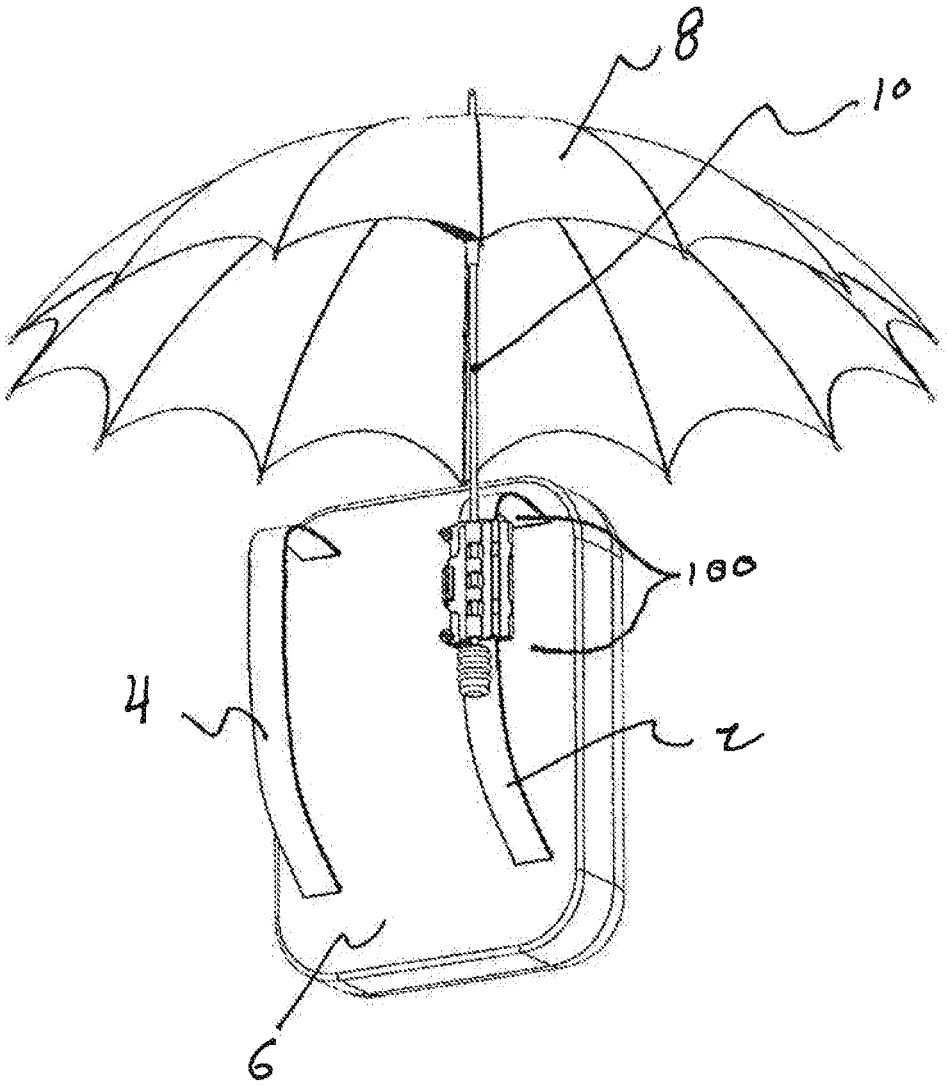
FIG. 1 is a perspective view of the invention attached to a backpack and holding an umbrella.

Referring now to FIG. 1 we see a perspective view of the present invention 100 attached to the strap 2 of a backpack 6. The invention 100 can also be attached to strap 4 if needed. The invention 100 holds the pole 10 of an umbrella 8. The pole 10 is securely held within the invention 100 so that the user can proceed in a hands-free manner while having the advantage of a deployed umbrella.

Figure 2:
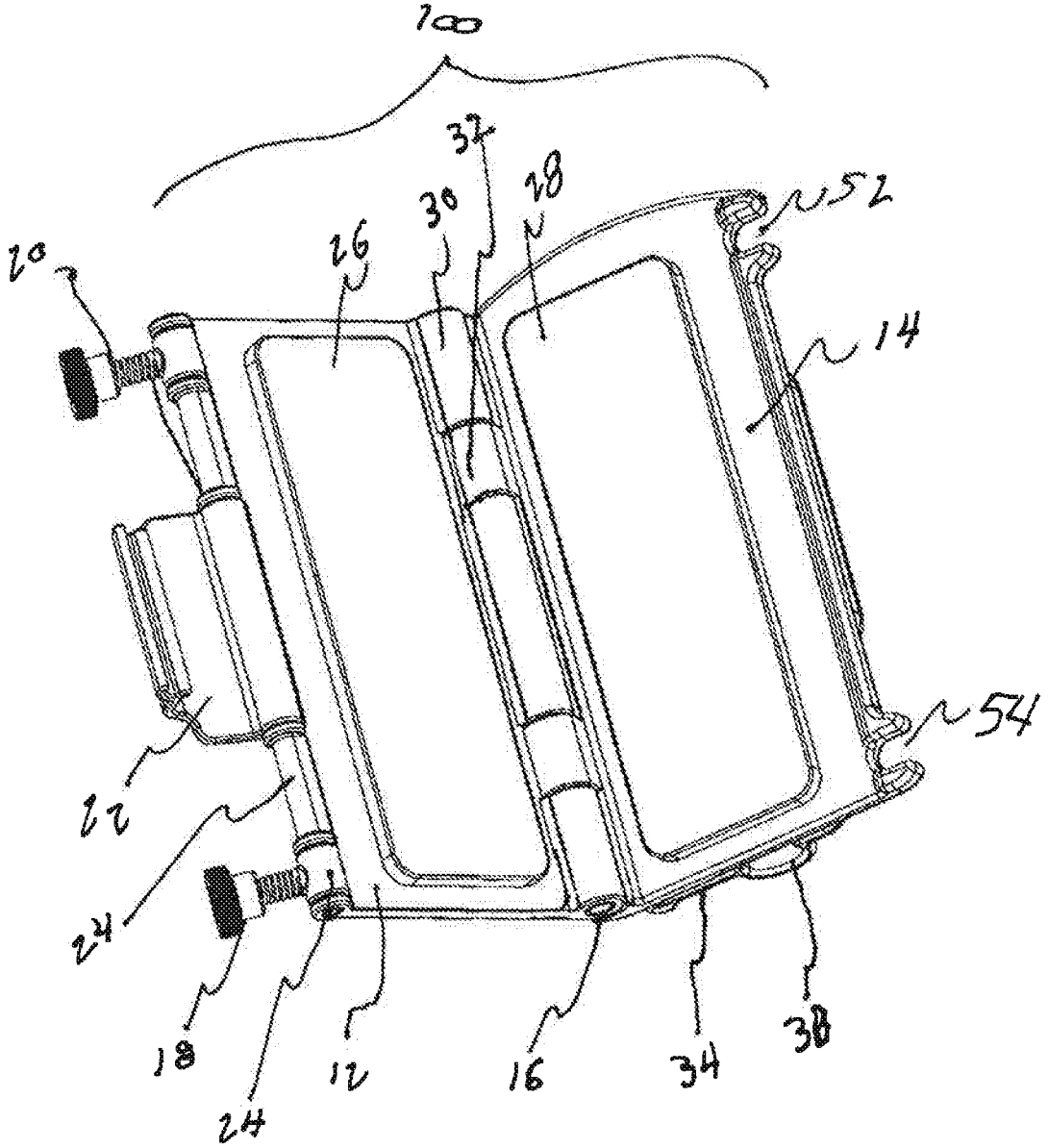
FIG. 2 is a perspective view of the invention where panels one and two are in the open position.

FIG. 2 is a perspective view of the invention 100 with first panel 12 and second panel 14 in the open position. The panels 12, 14 are hinged together by hinge members 30, 32 and hinge pin 16. U shaped cutouts 52, 54 on second panel 14 can be engaged by thumb screws 18, 20 to lock the two panels together. Resilient panels 26 and 28 help secure a backpack strap 2 so that the invention 100 will not slip on the strap 2 during use. The resilient pads 26, 28 also help accommodate straps of various thicknesses.

Figure 3:
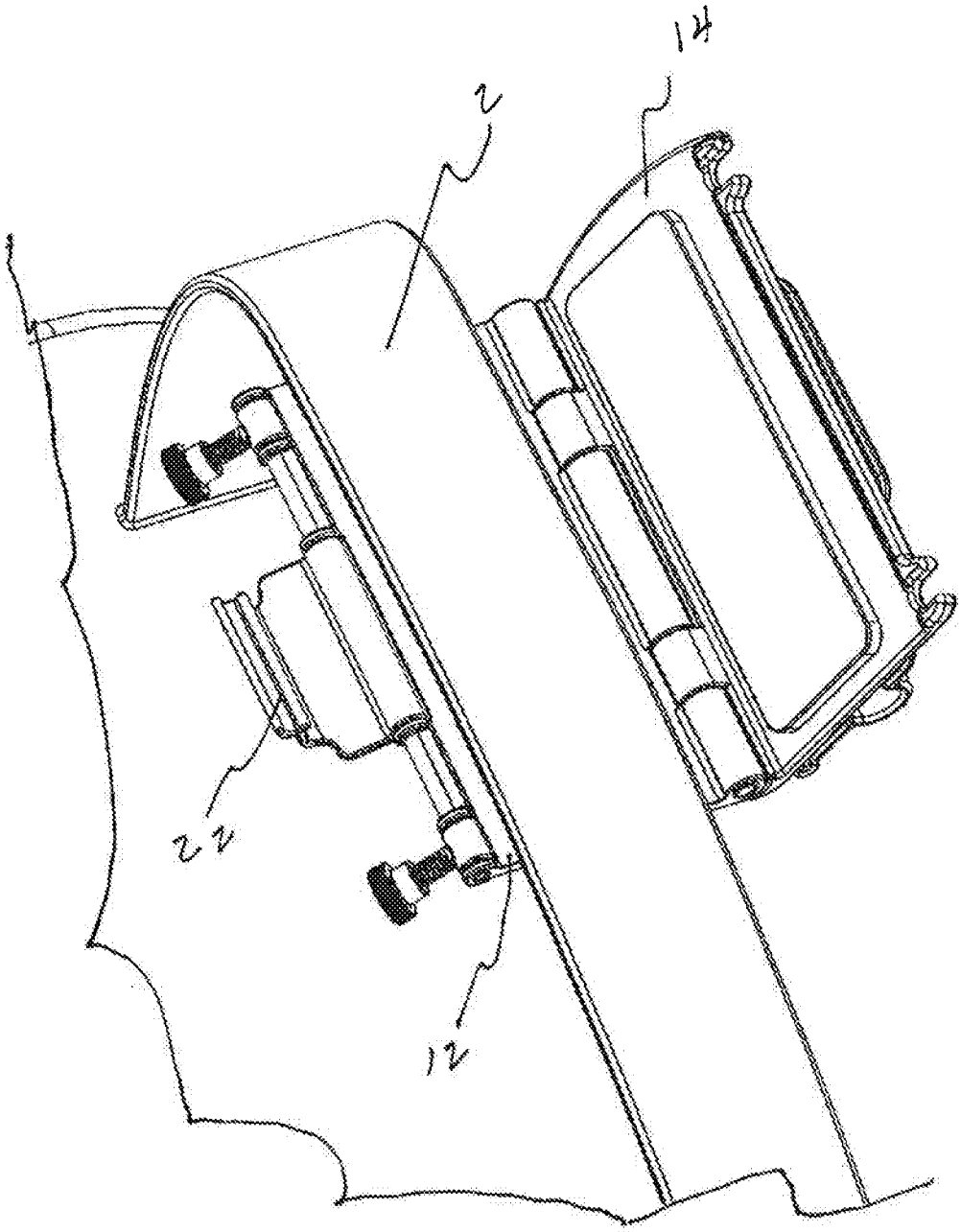
FIG. 3 is a perspective view showing a backpack strap inserted in the space between the first panel and the second panel.

FIG. 3 is a perspective view of the invention 100 showing backpack strap 2 in place and ready to be secured by second panel 14.

Figure 4:
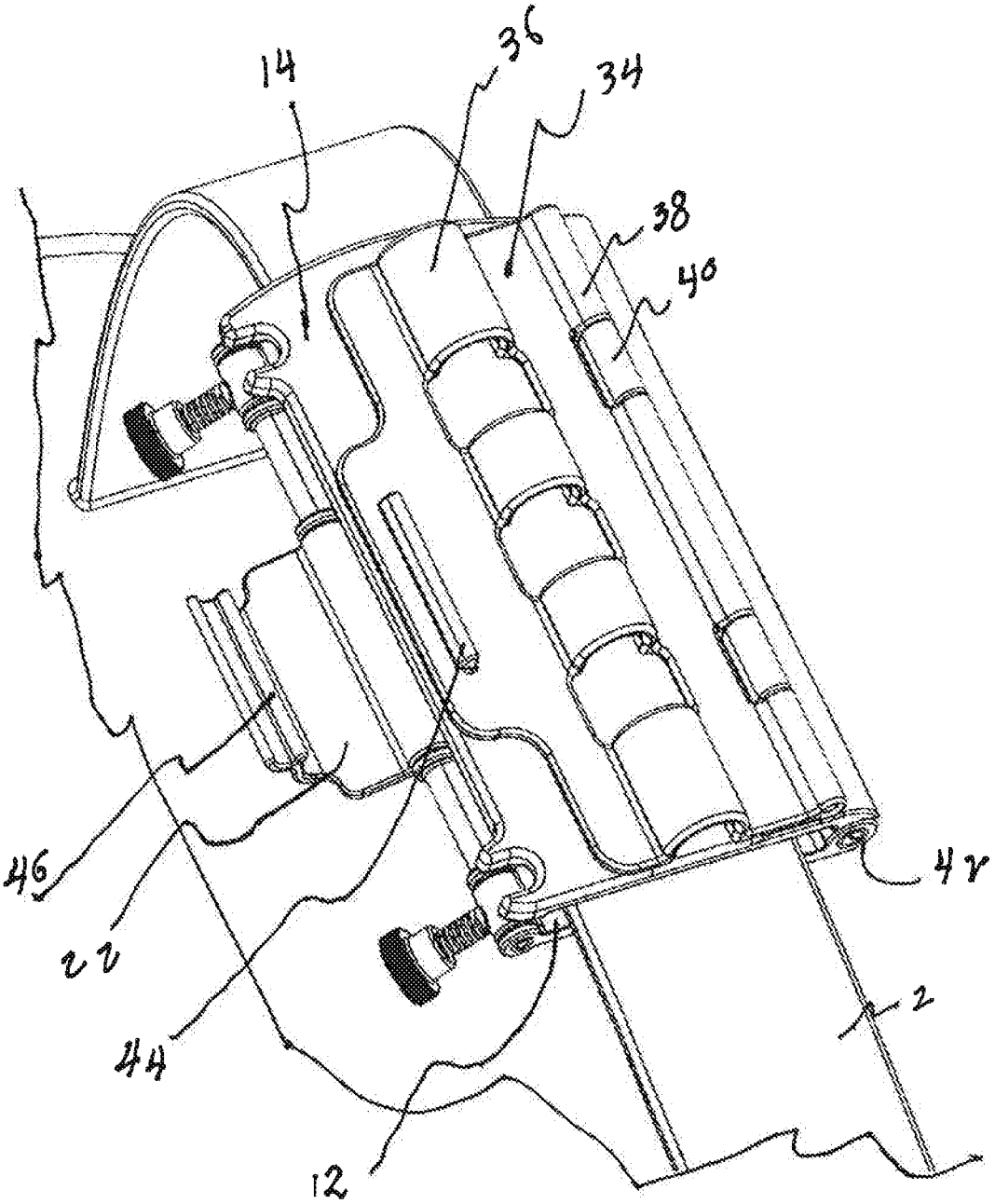
FIG. 4 is a perspective view showing the first and second panels in the closed position.

FIG. 4 is a perspective view of the invention showing second panel 14 folded down over first panel 12 thereby trapping strap 2 in place. Third panel 34 can be clearly seen and will be discussed in detail in FIGS. 6, 7 and 8. The third panel 34 is hinged at area 38, 40 to second panel 14 via hinge pin 42.

Figure 5:
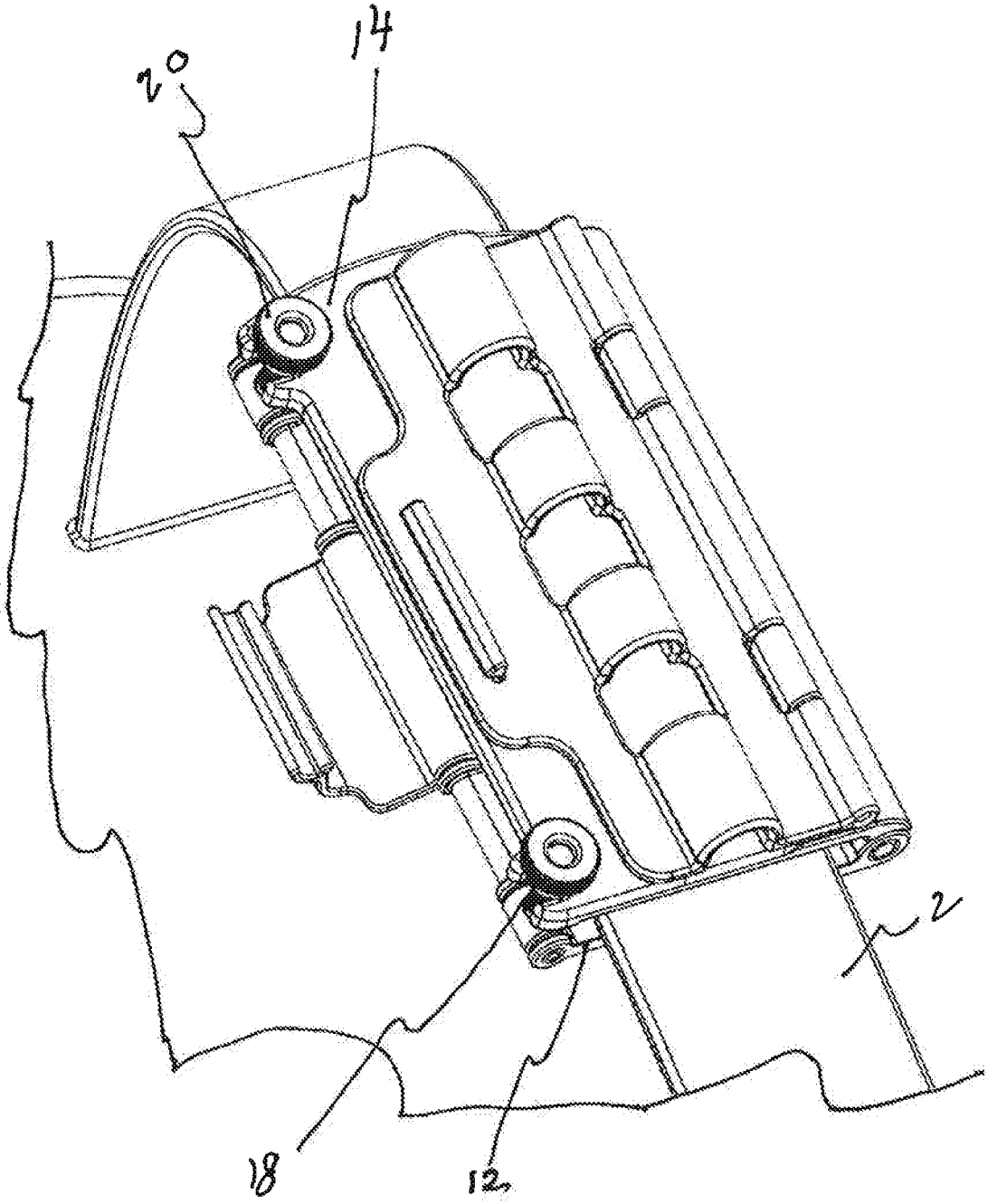
FIG. 5 is a perspective view showing the thumb screws deployed and holding the first and second panels together.

FIG. 5 is a perspective view of the invention 100 showing thumb screws 18, 20 engaged and locking panels 12 and 14 together firmly so that strap 2 cannot slip down during use.

Figure 6:
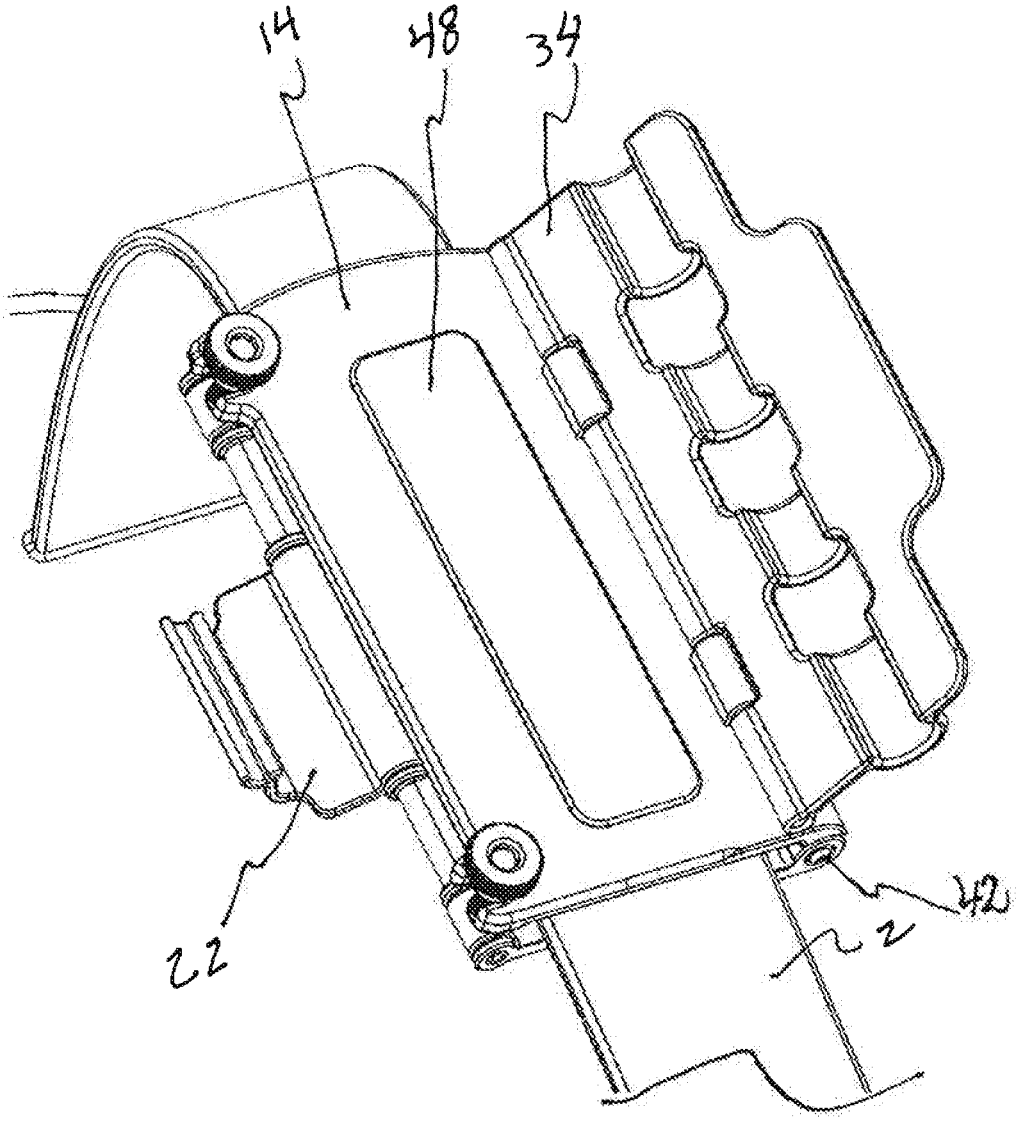
FIG. 6 is a perspective view of the third panel in the open position.

FIG. 6 shows third panel 34 in the open position connected by hinge pin 42 to second panel 14.

Figure 7:
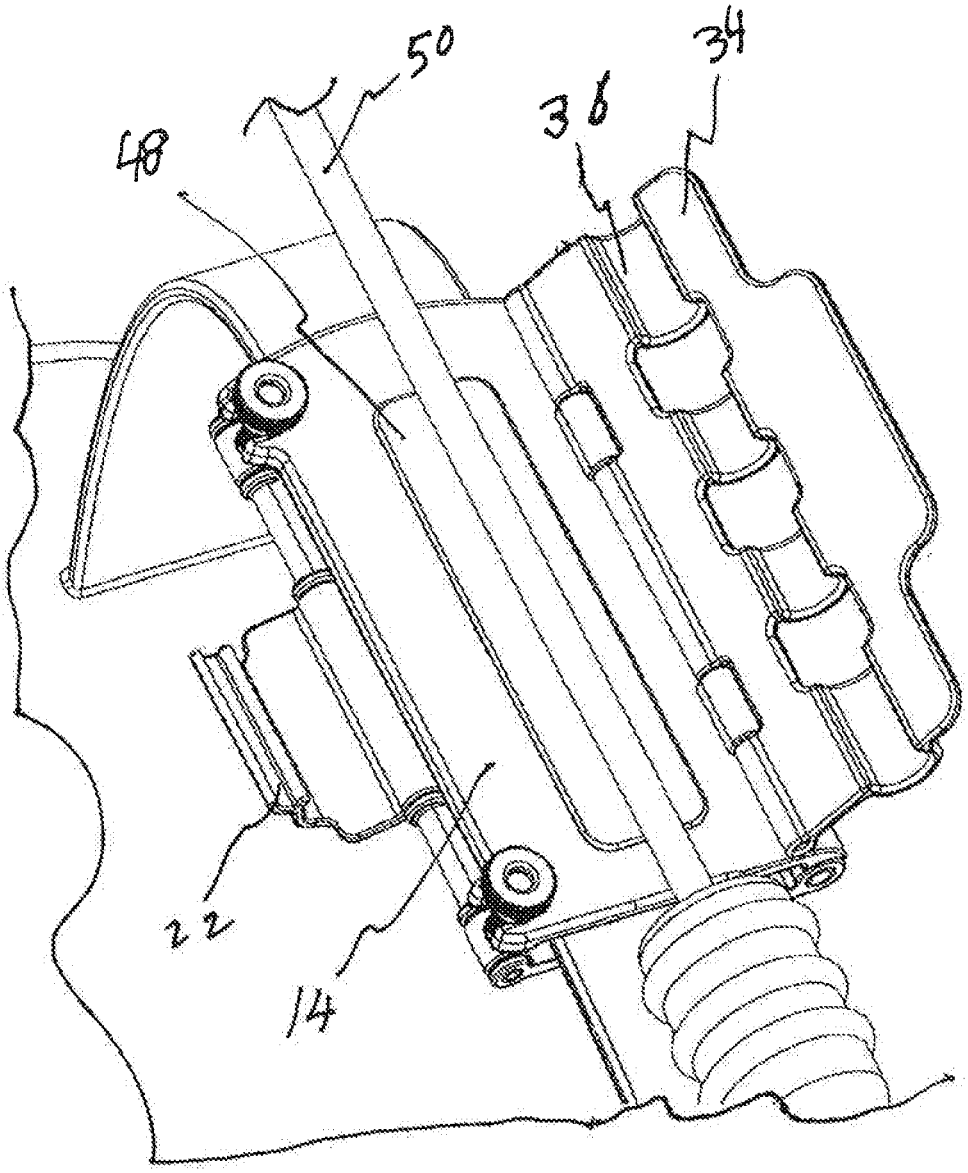
FIG. 7 is a perspective view of an umbrella pole placed between the second and third panels.

FIG. 7 is a perspective view showing an umbrella pole 50 placed on a resilient pad 48 and ready to be trapped by the U-shaped channel 36 of panel 34.

Figure 8:
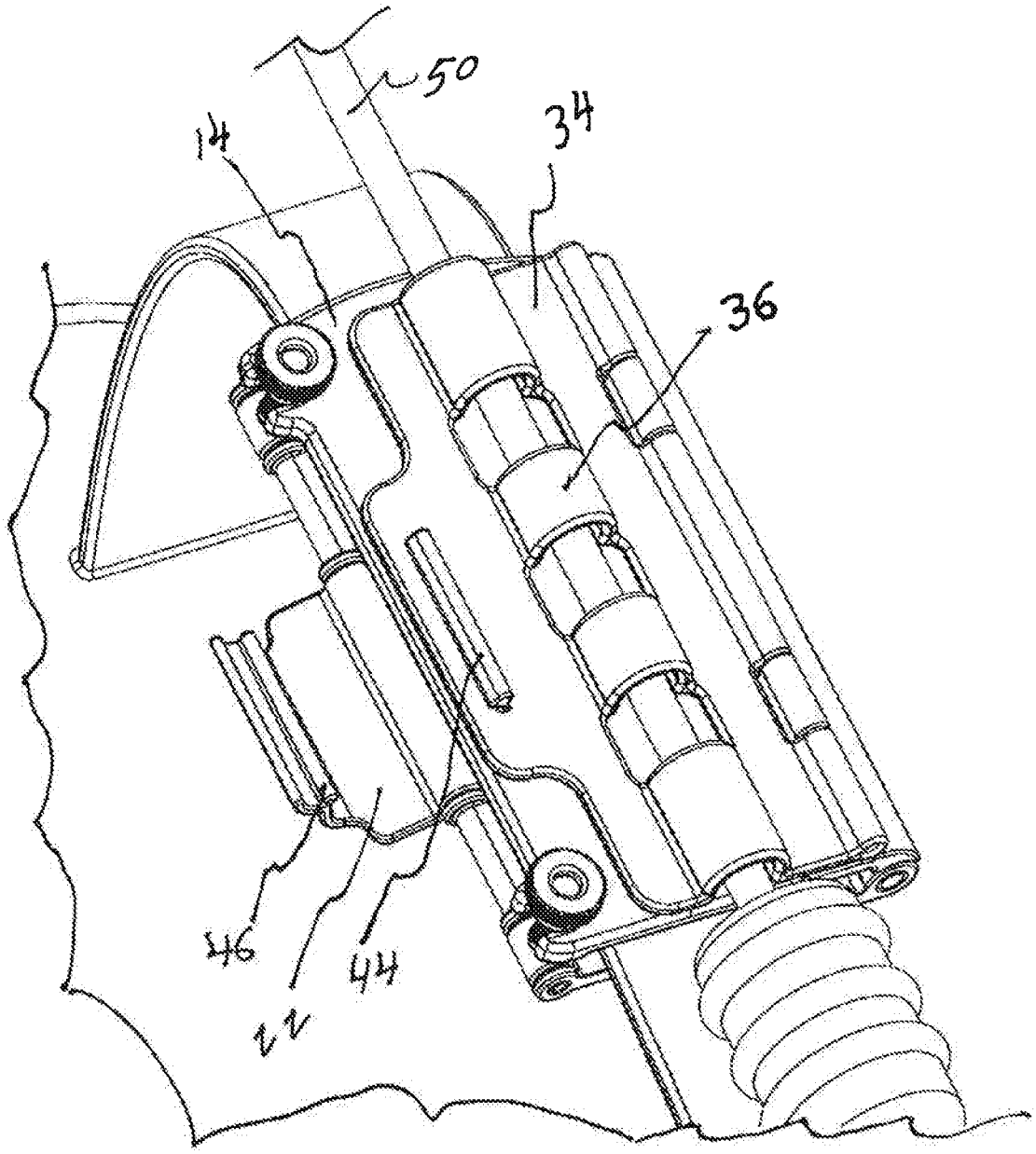
FIG. 8 is a perspective view of the second and third panels in the closed position.

FIG. 8 is a perspective view showing third panel 34 in the closed position and trapping umbrella pole 50. To lock panel 34 to panel 14 the user rotates hinged panel closure member 22 so that the locking rib 46 on closure member 22 snaps over the raised bar 44 on third panel 34 thereby locking umbrella pole 50 in place.

Figure 9:
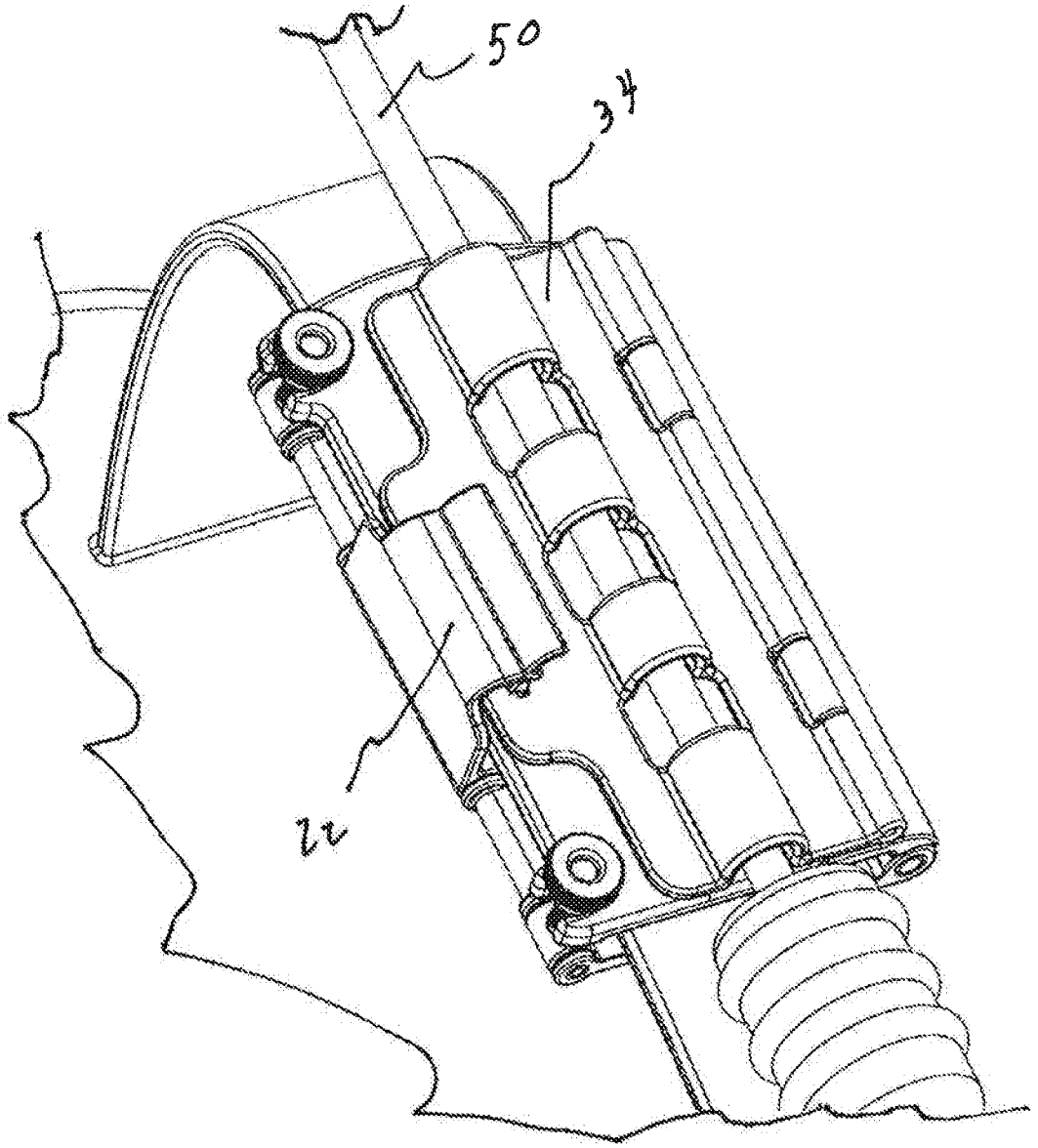
FIG. 9 is a perspective view showing the panel closure member in use holding the second and third panels together.

FIG. 9 is a perspective view showing panel closure member 22 in the locked position. The invention 100 is now ready to be worn by the user so that the user can have the benefit of a deployed umbrella without needing to physically hold the umbrella with her or his hands.

Figure 10:
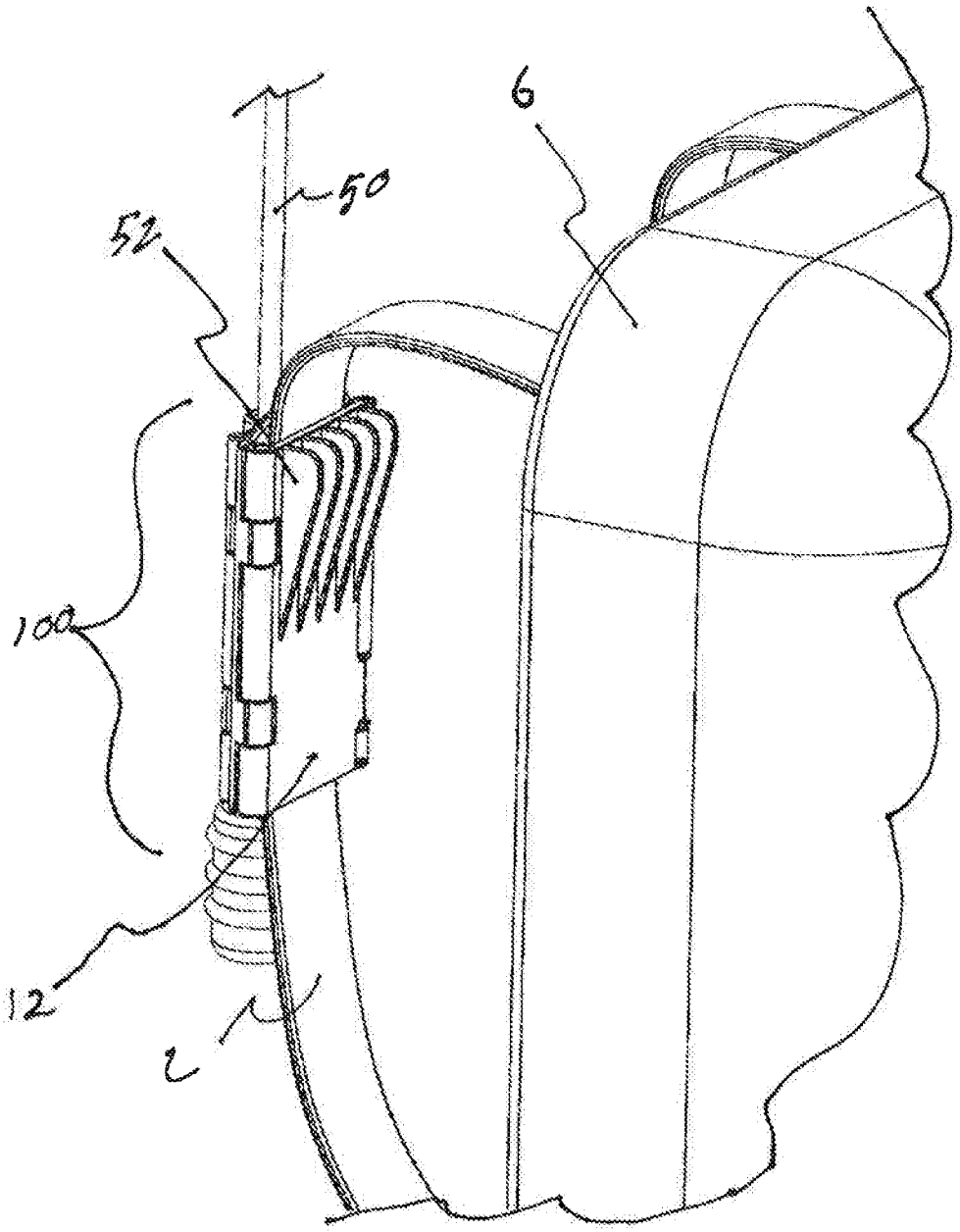
FIG. 10 is a perspective view showing the rear of panel one where triangular ribs help to hold the panel in correct alignment while the device is being worn and holding an umbrella.

FIG. 10 is a perspective view showing the rear portion of first panel 12. A plurality of triangular shaped ribs 52 act to position the invention 100 at the optimal angle with respect to the user's upper torso by accounting for the inward curve of the upper torso so that the invention 100 remains approximately perpendicular to the ground plane.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Umbrella holder comprising:

a first panel;

a second panel;

a third panel;

a pair of thumb screws;

a panel closure member;

said first panel hinged to said second panel;

said second panel hinged to said third panel;

said first and second panels creating a retaining space for a backpack strap;

said second and third panels creating a retaining space for an umbrella pole;

said third panel including a U-shaped channel for retaining said umbrella pole;

said second panel including a pair of U shaped cutouts for retaining the screw of said thumb screw;

said thumb screws being hingedly connected to the edge of said first panel;

said thumb screws capable of engaging said U-shaped cutouts of said second panel and being tightened to secure a backpack strap;

said second and third panels held together by said panel closure member;

said panel closure member hingedly connected to said first panel; and said third panel including a connector receiving ridge to allow said panel closure member to snap onto said connector receiving ridge.

2. Umbrella holder as claimed in claim 1 further comprising rubber cushion members attached to the underside of said U shaped channel of said second panel and attached to the flat surface of said first panel that interacts with said backpack strap.

3. Umbrella holder as claimed in claim 1 further comprising a plurality of triangular shaped ribs attached to the upper back portion of said first panel causing said first panel to be forced outward in relation to said backpack strap thereby compensating for the inward slop of said user's upper breast area and thereby allowing said umbrella pole to reside in a position that is approximately ninety degrees to the ground plane.

* * * * *